US006955412B2

(12) United States Patent
Hin

(10) Patent No.: US 6,955,412 B2
(45) Date of Patent: Oct. 18, 2005

(54) PRINT MECHANISM UTILIZING AN OPTICAL IMAGING SENSOR

(75) Inventor: Colin Chee Chong Hin, Penang (MY)

(73) Assignee: Agilent Technologies, Inc., Palo Alto, CA (US)

( * ) Notice: Subject to any disclaimer, the term of this patent is extended or adjusted under 35 U.S.C. 154(b) by 28 days.

(21) Appl. No.: 10/616,581

(22) Filed: Jul. 9, 2003

(65) Prior Publication Data

US 2005/0007408 A1 Jan. 13, 2005

(51) Int. Cl.[7] ..... B41J 29/393
(52) U.S. Cl. ..... 347/19
(58) Field of Search ..... 347/14, 19, 37; 400/74

(56) References Cited

U.S. PATENT DOCUMENTS 6,118,132 A * 9/2000 Tullis ..... 250/559.39
6,607,260 B1 * 8/2003 Ikeda ..... 347/19
6,709,085 B2 * 3/2004 Hoshino et al. ..... 347/19
6,719,467 B2 * 4/2004 Hess et al. ..... 400/76

FOREIGN PATENT DOCUMENTS

GB 2356600 A * 5/2001 ..... B41J 19/20

* cited by examiner

*Primary Examiner*—Thinh Nguyen

(57) ABSTRACT

A print mechanism and method for printing are disclosed. The print mechanism includes a print head assembly, an actuator for moving the same, and a controller. The print head assembly includes a position detector and a marking device. The position detector includes an imaging device for periodically forming an image of a portion of a print medium. The actuator moves the print head assembly relative to the print medium in a predetermined direction. The controller compares first and second images formed by the imaging device at first and second times, respectively, while the print head assembly moves relative to the print medium and determines a displacement of the print head assembly between the first and second times from the images. The controller causes the marking device to mark the print medium at locations determined by the determined displacement.

8 Claims, 2 Drawing Sheets

PRINT MECHANISM UTILIZING AN OPTICAL IMAGING SENSOR

FIELD OF THE INVENTION

The present invention relates to printing systems having movable print heads.

BACKGROUND OF THE INVENTION

To simplify the following discussion, the present invention will be explained in terms of a typical inkjet printing mechanism; however, it will become apparent from the following discussion that the present invention may be applied to a much wider class of printers. Inkjet printing mechanisms are relatively inexpensive, and hence, inkjet printers are well suited to the personal computer market where capital cost is a key factor in the selection of a printer. In addition, this type of mechanism is employed in very large format printers such as those used to generate architectural drawings and in high-resolution color printers used to create color prints from digital photographs.

Inkjet printers utilize a printing mechanism in which a print head prints a swath of dots as the print head moves across the page in the horizontal direction. The swath typically includes one or more vertical columns of dots. After each swath is printed, the paper is typically advanced in the vertical direction by an amount equal to the height of the swath. The vertical positions of the dots within a swath are determined by the positions of the inkjets in the print head, which are fixed at manufacturing and controlled to a very high accuracy. The horizontal position of each column of drops is controlled by firing the droplet mechanism at times determined by a clock as the print head moves across the paper at a constant speed in one prior art mechanism. The accuracy of the dot placement depends on the horizontal actuator propelling the print head at a very constant speed. Any variation in the print head speed leads to errors in the dot positions.

The separations between successive swaths must be tightly controlled to avoid printing artifacts. Print registration artifacts are easily discerned in multi-color printing, since such artifacts can alter the tone of the perceived color. Tolerances of less than a micron are required in high-resolution color printing.

In principle, the accuracy of the horizontal dot placement can be improved by utilizing a precision actuator or some form of absolute positioning mechanism. However, such systems are costly, and, as noted above, the initial cost of the printer is a key factor in the selection of a printer.

SUMMARY OF THE INVENTION

The present invention includes a print mechanism and method for printing. The print mechanism includes a print head assembly, an actuator for moving the same, and a controller. The print head assembly includes a position detector and a marking device. The position detector includes an imaging device for periodically forming an image of a portion of a print medium. The actuator moves the print head assembly relative to the print medium in a predetermined direction. The controller compares first and second images formed by the imaging device at first and second times, respectively, in a time interval in which the actuator has moved the print head assembly relative to the print medium. The controller determines a displacement of the print head assembly between the first and second times from the images. The controller causes the marking device to mark the print medium at locations determined by the determined displacement while the print head assembly is moving relative to the print medium. In one embodiment, the actuator moves the print head assembly relative to the print medium at a speed that depends on an input signal to the actuator. The input signal is varied in response to the determined displacement so as to reduce fluctuations in the speed. In another embodiment, the marking device is caused to mark the print medium at a location that depends on the determined displacement. In yet another embodiment, the imaging device includes an image sensor for generating a one-dimensional image of the print medium in a direction parallel to the predetermined direction. The imaging device includes a light source for illuminating the print medium at an angle that is less than 45 degrees with respect to a surface of the print medium in yet another embodiment. The present invention is well adapted for use with a marking device that includes an ink-dispensing mechanism for depositing ink droplets on the print medium.

DETAILED DESCRIPTION OF THE PREFERRED EMBODIMENTS OF THE INVENTION

Figure 1:
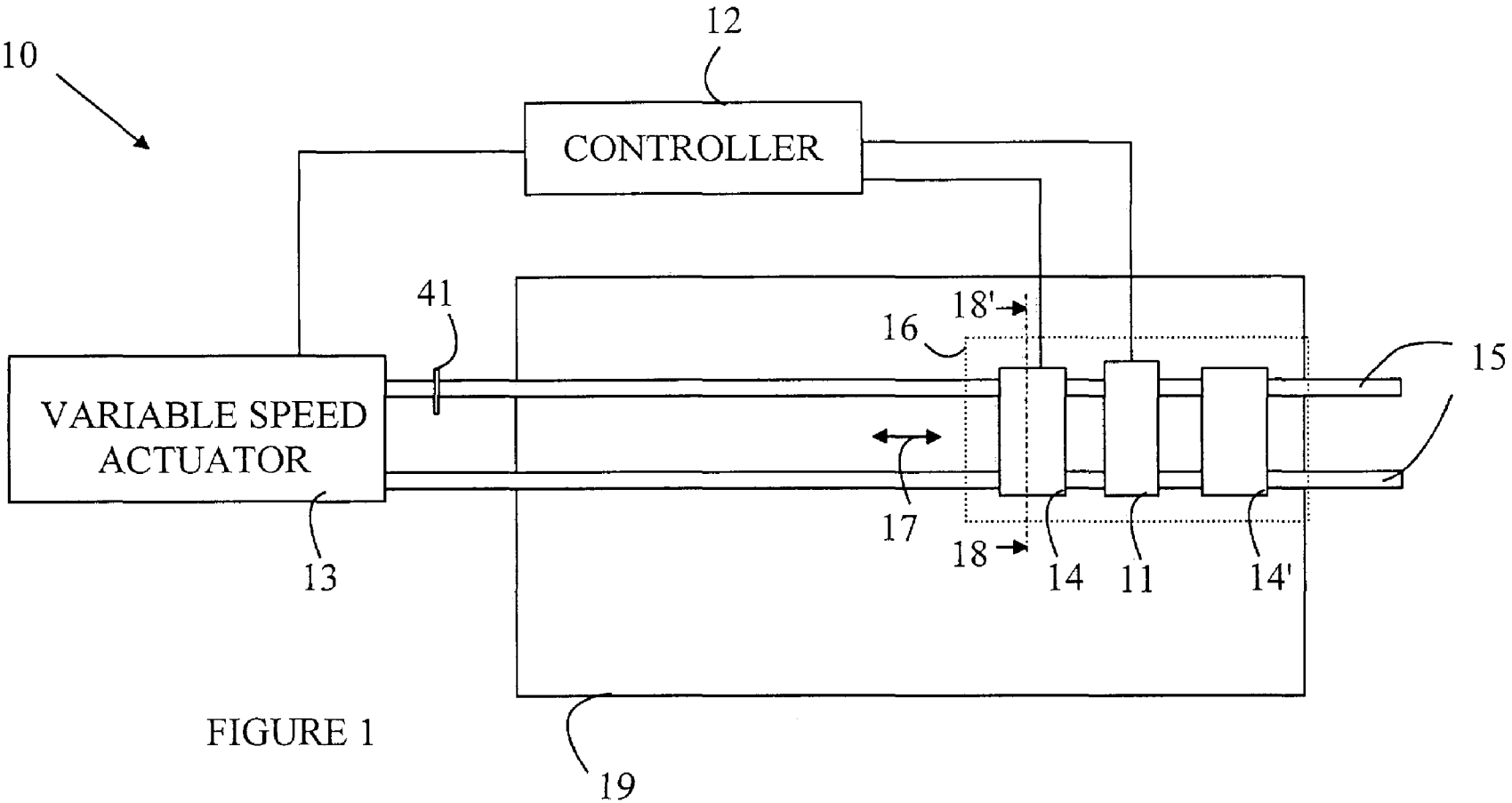
FIG. 1 is a top view of a horizontal print mechanism 10 according to the present invention positioned over a portion of a sheet of paper 19.

The manner in which the present invention provides its advantages can be more easily understood with reference to FIG. 1, which is a top view of a horizontal print mechanism 10 according to the present invention positioned over a portion of a sheet of paper 19. Mechanism 10 includes a print head assembly 16 that rides on a carriage 15 under the control of a variable speed actuator 13 that moves the print head assembly in the direction shown by arrow 17. Print head assembly 16 includes an ink-dispensing head 11 and a position detector 14.

In inkjet embodiments of the present invention, ink dispensing head 11 includes the inkjet nozzles and the associated circuitry for causing ink-dispensing head 11 to deposit one or more columns of ink drops on paper 19 in response to control signals from controller 12. Since such dispensing heads are known to the art, they will not be discussed in detail here.

The position of ink-dispensing head 11 relative to a fiducial mark 41 is estimated by controller 12. In general, the columns in ink drops are to be aligned with a predetermined grid on the paper. If the motor speed is constant, the position of ink-dispensing head 11 may be computed from the known motor speed and the time since ink-dispensing head 11 passed fiducial mark 41. In this case, controller 12 triggers the nozzles in ink-dispensing head 11 in response to a clock signal generated by a clock in controller 12. If the speed varies over the range of travel in a known manner, the position of the ink-dispensing head relative to the fiducial mark can be determined by integrating the measured speed over the time interval since the ink-dispensing head passed the fiducial mark. The ink-dispensing head can then be triggered when controller 12 estimates that it is over the next grid position to receive ink-drops.

Position detector 14 images the surface of paper 19 at regular intervals as print head assembly 16 moves over paper 19. The time intervals are chosen such that the images from successive fields of view partially overlap by an amount sufficient to enable controller 12 to measure the distance traveled by print head assembly 16 between images. In one embodiment of the present invention, controller 12 computes the speed at which print head assembly 16 is moving in the horizontal direction and then adjusts the speed of variable speed actuator 13 via a feedback signal thereto to reduce variations in the speed as the print head assembly moves across the paper.

Figure 2:
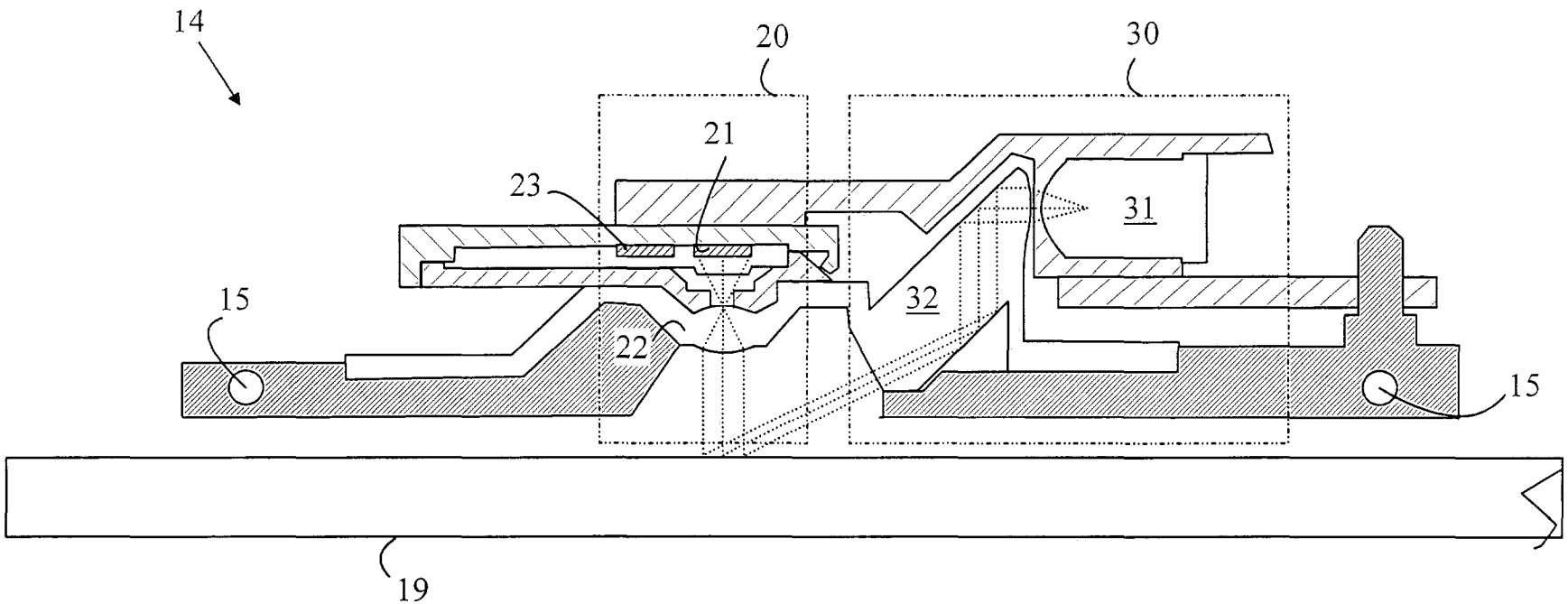
FIG. 2 is a cross-sectional view of position detector 14 through line 18–18' shown in FIG. 1.

Refer now to FIG. 2, which is a cross-sectional view of position detector 14 through line 18–18' shown in FIG. 1. Position detector 14 may be viewed as having two principal components, an illumination section 30 and an imaging section 20. Illumination section 30 typically includes an LED light source 31 and an optical assembly 32 that illuminates the surface of the paper 19 with collimated light that strikes the surface at a shallow angle relative to the surface. For example, the angle of the incident light relative to the surface of the paper is less than 45 degrees. Light from the illuminated portion of the surface is imaged by the imaging section onto a sensor 21 with the aid of a lens assembly 22.

While the surface of paper 19 may appear to be a uniform white, the fibers that make up the paper and other minute surface irregularities form a complex pattern that varies from place to place on the surface. The shallow angle of incidence of the illumination accentuates this pattern. Hence, sensor 21 receives a complex image that varies with the imaged location.

When the position detector is moved relative to the surface, the image shifts on sensor 21. If images are taken sufficiently close together in time, each successive image will contain a portion of the previous image. Hence, by comparing two successive images, position detector 14 can determine the offset between the images. For example, position detector 14 can compute the correlation of the first image shifted by various amounts with the second image. The shift that provides the highest correlation is assumed to be the displacement of the position detector during the period of time that elapsed between the times at which the two images were taken. It should be noted that only shifts in the horizontal direction need be considered in the preferred embodiment. Hence, a one-dimensional image sensor can be utilized, and only shifts in the horizontal direction need be tested. In the embodiment shown in FIG. 1, it is assumed that controller 12 performs the displacement computations and outputs a signal indicative of the motion. However, embodiments in which an onboard controller 23 is utilized for this purpose can also be constructed.

The above-described embodiments of the present invention have utilized a print head assembly in which position detector 14 is separate from the ink-dispensing head 11. However, embodiments in which the position detector is part of the ink-dispensing head can also be practiced. The preferred embodiment utilizes separate assemblies, since the ink-dispensing head is disposable, and hence, the cost of the printer is reduced by utilizing separate assemblies, since the position detector has a lifetime that is many times that of an ink-cartridge. However, it should be noted that ink-dispensing heads that include imaging sensors have been proposed to provide feedback to the ink-dispensing system. In such a system, the present invention could, in principle, utilize the ink-dispensing head imaging sensor if that imaging sensor has sufficient resolution.

The above-described embodiments of the present invention assume that position detector 14 images the surface of the unprinted paper to provide the successive images used to measure the displacement of the print head assembly. However, it should be noted that the presence of ink drops on the region of the paper that is imaged does not prevent the displacement measurement from achieving the required accuracy, provided the printed pattern is sufficiently random over the area being imaged. If this is not the case, position detector 14 can be placed so that it images an area that is ahead of the ink-dispensing head, and hence, views only the area of the paper that has not yet been printed. In printers in which the print head assembly dispenses ink in both directions of travel, a second position detector such as position detector 14' shown in FIG. 1 can be included. Controller 12 then switches between position detectors 14 and 14' when the direction of motion of print head assembly 16 changes such that the position detector that views the paper ahead of ink-dispensing head 11 in the current direction of travel is utilized to measure the displacement of the print head assembly 16.

The above-described embodiments of the present invention assume that positional information generated by comparing successive images taken by position detector 14 is utilized only to adjust the speed of variable speed actuator 13. In such an embodiment, controller 12 includes a clock that is used to trigger ink-dispensing head 11 at regular intervals. The intervals are determined by a design speed. If the motor speed is close to the design speed, the resultant droplet locations will be very close to a predetermined grid on the paper. If, however, the speed varies somewhat within the servo loop, a corresponding uncertainly will be introduced into the droplet positions.

To avoid such uncertainties, embodiments in which the trigger timing is varied in response to the observed dispensing head speed can also be utilized. In such embodiments, if the observed speed is higher than the design speed, controller 12 triggers ink-dispensing head 11 at an earlier time that is determined by the observed speed. Similarly, if the observed speed is less than the design speed, controller 12 will delay the triggering of ink-dispensing head 11 by an amount of time determined by the observed speed so as to more closely align the droplets with the predetermined grid. This strategy is equivalent to integrating the observed speed versus position curve over the time interval since the ink-dispensing head passed over the fiducical mark triggering the ink-dispensing head when controller 12 estimates that the head is over the desired grid position.

This timing strategy can be utilized in addition to the servo loop that controls the motor speed or in place thereof. If the motor speed fluctuations are within a reasonable range during normal operation, alerting the droplet timing can correct for the fluctuations in droplet positions that would be induced by the speed fluctuations. A motor system with a servo-loop is often more expensive to implement than a timing change. The servo loop system requires a variable speed motor and the interface circuitry needed to drive the system. In contrast, a system in which the timing is changed typically requires only a change in the software contained in controller 12. Hence, changing the timing in response to the observed speed fluctuations typically provides a more cost-effective solution in systems in which the speed fluctuations are small but significant enough to introduce printing artifacts.

The above-described embodiments of the present invention have utilized ink-jet printers. However, the present invention can be implemented on any printing device having a similar mechanism in which a marking device is moved over the print medium and caused to mark the medium at particular locations defined by a controller. For example, some thermal printers also utilize a print head assembly that moves across the paper on an actuator driven carriage in which dots are printed on the paper by timing the firing of a heat source in the print head assembly. Similarly, impact printers in which a hammer is triggered to generate dots or formed characters often utilize print head assemblies that move across the page and trigger a marking mechanism at locations on a predetermined grid.

The above-described embodiments of the present invention have been used to control the horizontal firing position of the ink-jet printing mechanism. However, the present invention may be utilized to control the vertical motion of the printing mechanism as well.

Various modifications to the present invention will become apparent to those skilled in the art from the foregoing description and accompanying drawings. Accordingly, the present invention is to be limited solely by the scope of the following claims.

What is claimed is:

1. A print mechanism comprising:

a print head assembly comprising a position detector and a marking device, said position detector comprising an imaging device for periodically forming an image of a portion of a print medium;

an actuator for moving said print head assembly relative to said print medium in a predetermined direction; and a controller for comparing first and second images formed by said imaging device at first and second times, respectively, in a time interval in which said actuator has moved said print head assembly relative to said print medium and for determining a displacement of said print head assembly between said first and second times, said controller causing said marking device to mark said print medium at locations determined by said determined displacement while said print head assembly is moving relative to said print medium, wherein said actuator moves said print head assembly relative to said print medium at a speed that depends on an input signal to said actuator and wherein said input signal is varied in response to said determined displacement so as to reduce fluctuations in said speed.

2. The print mechanism comprising:

a print head assembly comprising a position detector and a marking device, said position detector comprising an imaging device for periodically forming an image of a portion of a print medium;

an actuator for moving said print head assembly relative to said print medium in a predetermined direction; and a controller for comparing first and second images formed by said imaging device at first and second times, respectively, in a time interval in which said actuator has moved said print head assembly relative to said print medium and for determining a displacement of said print head assembly between said first and second times, said controller causing said marking device to mark said print medium at locations determined by said determined displacement while said print head assembly is moving relative to said print medium, wherein said imaging device comprises an image sensor for generating a one-dimensional image of said print medium in a direction parallel to said predetermined direction.

3. The print mechanism of claim 2 wherein said marking device comprises a light source for illuminating said print medium at an angle that is less than 45 degrees with respect to a surface of said print medium.

4. The print mechanism of claim 2 wherein said marking device comprises an ink-dispensing mechanism for depositing ink droplets on said print medium.

5. A method for printing on a print medium, said method comprising:

causing a print head assembly comprising a position detector and a marking device, to move across said print medium in a predetermined direction, said position detector comprising an imaging device for periodically forming an image of a portion of a print medium;

comparing first and second images formed by said position detector at first and second times, respectively, in a time interval in which said print head assembly has moved relative to said print medium and determining a displacement of said print head assembly between said first and second times; and causing said marking device to mark said print medium at locations determined by said determined displacement while said print head assembly is moving relative to said print medium, wherein said print head assembly moves relative to said print medium at a speed that depends on an input signal to an actuator and wherein said input signal is varied in response to said determined displacement so as to reduce fluctuations in said speed.

6. The method of claim 5 wherein said print medium is illuminated by a light source that generates light at an angle that is less than 45 degrees with respect to a surface of said print medium.

7. The method of claim 5 wherein said marking device deposits ink droplets on said print medium.

8. A method for printing on a print medium, said method comprising:

causing a print head assembly comprising a position detector and a marking device, to move across said print medium in a predetermined direction, said position detector comprising an imaging device for periodically forming an image of a portion of a print medium;

comparing first and second images formed by said position detector at first and second times, respectively, in a time interval in which said print head assembly has moved relative to said print medium and determining a displacement of said print head assembly between said first and second times; and causing said marking device to mark said print medium at locations determined by said determined displacement while said print head assembly is moving relative to said print medium, wherein said first and second images are one-dimensional images of said print medium generated in a direction parallel to said predetermined direction.

* * * * *